US006332807B1

(12) United States Patent
Asakura et al.

(10) Patent No.: US 6,332,807 B1
(45) Date of Patent: Dec. 25, 2001

(54) CONNECTION STRUCTURE AND CONNECTION METHOD BETWEEN SHIELD ELECTRIC WIRE AND SHIELD TERMINAL

(75) Inventors: Nobuyuki Asakura; Yasumichi Kuwayama, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/564,802

(22) Filed: May 5, 2000

(30) Foreign Application Priority Data

May 7, 1999 (JP) ..... 11-127549

(51) Int. Cl.[7] ..... H01R 9/05
(52) U.S. Cl. ..... 439/578; 174/89
(58) Field of Search ..... 439/100, 578, 439/98; 174/89

(56) References Cited

U.S. PATENT DOCUMENTS 2,785,384 * 3/1957 Wickesser ..... 174/89
5,183,412 * 2/1993 Nagafuji ..... 439/578
5,607,325 * 3/1997 Toma ..... 439/578

FOREIGN PATENT DOCUMENTS 6-22427 * 1/1994 (JP) ..... 174/89
8-78071 3/1996 (JP) .

* cited by examiner

*Primary Examiner*—Neil Abrams
(74) *Attorney, Agent, or Firm*—Finnegan, Henderson, Farabow, Garrett & Dunner, L.L.P.

(57) ABSTRACT

A shield electric wire includes braided wires, an outer insulating portion for covering the braided wires, and a rib-like connecting portion that is formed by part of the braided wires. A second outer insulating portion is provided that is formed by separating it from an end of the outer insulating portion and dragging it away from the end of the outer insulating portion to expose part of the braided wires. The second outer insulating portion remains on the braided wires to cover the ends of the braided wires. The second outer insulating portion is then drawn back towards the end of the outer insulating portion to draw up and collect the parts of the braided wires exposed between the outer insulating portion and the second outer insulating portion to thereby form the rib-like connecting portion. A shield terminal is connected to the connecting portion.

13 Claims, 4 Drawing Sheets

CONNECTION STRUCTURE AND CONNECTION METHOD BETWEEN SHIELD ELECTRIC WIRE AND SHIELD TERMINAL

BACKGROUND OF THE INVENTION

The present invention relates to a connection structure between a shield electric wire and a shield terminal and a connection method therebetween.

A shield connector that is disclosed in Japanese Patent Application Laid-Open No. 8-78071 has a shield electric wire, a terminal electrically connected to a core wire of the shield electric wire, a shield terminal electrically connected to a braided wire of the shield electric wire, a housing for accommodating these elements therein, and a cap mounted on a forward end of the shield terminal.

The shield terminal and the braided wire are connected to each other by the use of the following method. The method is first to peel an insulating outer covering at one end of the shield electric wire to thereby cause the braided wire to be exposed, to fold the exposed braided wire back onto the insulating outer covering to thereby superpose this braided wire upon the insulating outer covering, and then to peel an insulating inner covering to thereby cause the core wire to be exposed. Next, the method is to pass the insulating inner covering through a terminal-retaining portion of the terminal and to caulk the terminal-retaining portion to thereby electrically connect the core wire and the terminal. Finally, the method is to insert the shield electric wire into the housing to thereby connect the shield terminal and the braided wire to each other.

The connection between the shield terminal and the braided wire is achieved through the press contacting of the braided wire with respect to a plurality of blade spring pieces disposed within the shield terminal.

SUMMARY OF THE INVENTION

However, in the above-described conventional structure, it is necessary to perform the peeling of the insulating outer covering over a wide range to thereby expose the braided wire. Therefore, the operation of eliminating the insulating outer covering is troublesome. In addition, for the purpose of preventing the braided wire and the core wire from being short-circuited, the braided wire must be cut to a prescribed length. Because the blade spring pieces are needed to be disposed within the shield terminal, the structure of the shield terminal becomes complex. When causing an increase in the blade loading of the blade spring piece in order to make the contact between this spring piece and the braided wire reliable, there is the likelihood that the braided wire will become hard to insert between the blade spring pieces. Simultaneously, there is also the likelihood that the braided wire will be dragged up and so a defective contact will occur between the braided wire and the blade spring piece. In addition, the terminal end of the braided wire becomes likely to get frayed and so the connection thereof to the shield terminal becomes more and more difficult.

Thereupon, it is an object of the present invention to provide a highly reliable connection structure that makes it possible to reliably and easily perform an electric connection between the shield terminal and the braided wire.

To achieve the above object, in the structure according to the present invention, the shield electric wire has braided wires, an outer insulating portion for covering the braided wires, and a connecting portion formed using part of the braided wires. The connecting portion is formed by drawing up the braided wires extended and exposed from the end of the outer insulating portion and collecting them together to the end thereof, and has a rib-like configuration. The shield terminal is connected to the connecting portion.

According to this construction, the rib-like connecting portion that has been formed by the braided wires being drawn near and collected together is connected to the shield terminal. Therefore, between the shield terminal and the connecting portion, there is attained a state of surface contact where the contact area between the both has been sufficiently ensured. As a result, the braided wires and the shield terminal are directly connected together. Accordingly, a stable electrical connection is obtained with a simple structure and in addition the braided wires are prevented from getting frayed.

DESCRIPTION OF THE PREFERRED EMBODIMENTS

Figure 1:
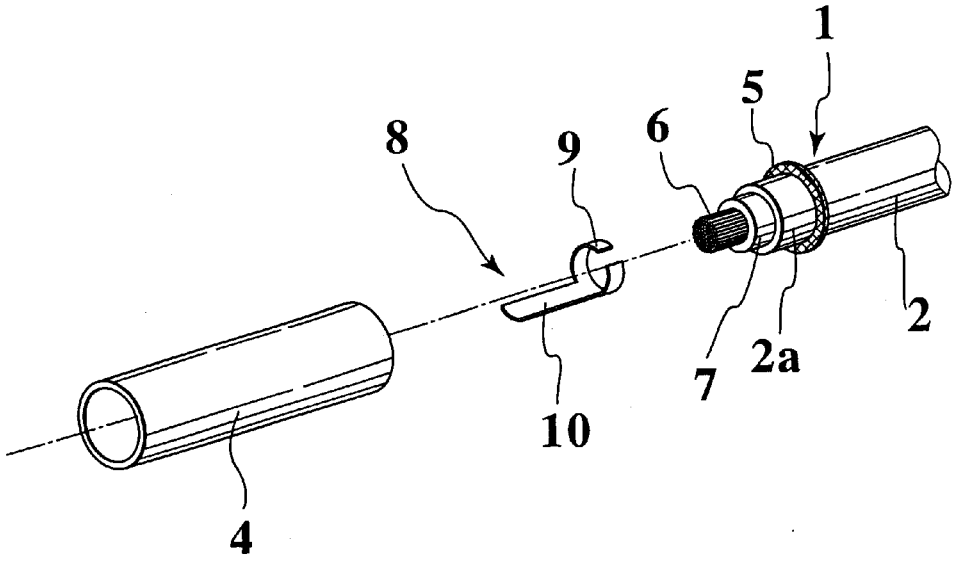
FIG. 1 is an exploded perspective view illustrating a connection structure of a shield electric wire according to an embodiment of the present invention.

A concrete embodiment, to which the present invention has been applied, will now be explained in detail with reference to the drawings.

First, a connection structure of a shield electric wire according to this embodiment will be explained.

As illustrated in FIGS. 1 to 4, in the connection structure of a shield electric wire 1, a shield terminal 4 is electrically connected to braided wires 3 that have been exposed by part of an insulating outer covering (outer insulating portion) 2 being peeled away. Being drawn up and collected to an end surface of the insulating outer covering 2, the exposed braided wires 3 constitute a rib-like connecting portion 5. The rib-like connecting portion 5 is connected to the shield terminal 4.

Figure 2:
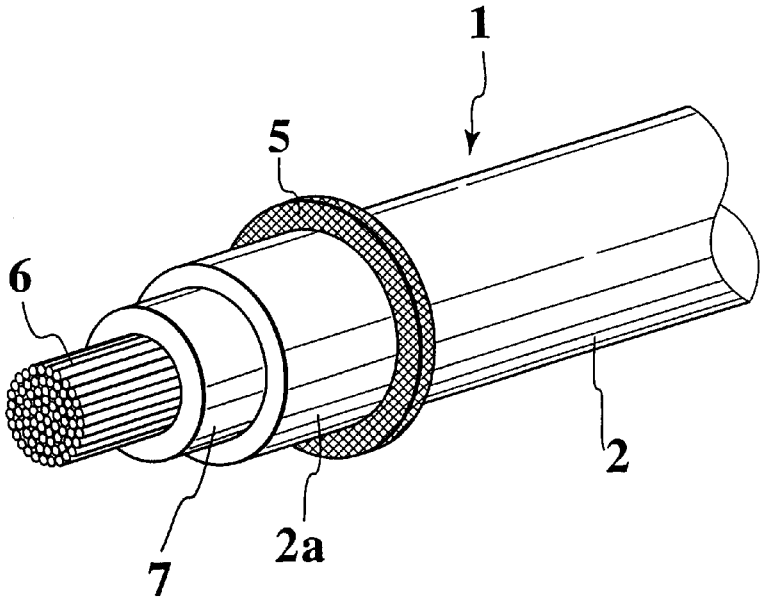
FIG. 2 is an enlarged perspective view illustrating a main part of a terminal processed portion of the electric wire according to the embodiment.

As illustrated in FIGS. 1 and 2, the shield electric wire 1 has core wires 6 each consisting of a conductor, and an insulating inner covering (inner insulating portion) 7 that covers the core wires. The shield electric wire 1 also has braided wires 3 that have been disposed on an outer surface of the insulating inner covering 7 so as to cover this insulating inner covering 7. Further, the shield electric wire 1 also has an insulating outer covering 2 that covers on an outer-peripheral surface of the braided wires 3 the core wires 6, the insulating inner covering 7, and the braided wires 3 and that is formed of insulating resin.

As illustrated in FIG. 2, on one end portion of the shield electric wire 1 there is provided the rib-like connecting portion 5 made up of the braided wires 3. The rib-like connecting portion 5 is formed by drawing up an outer covering 2*a* partly separated from the insulating outer covering 2 to the end surface of the insulating outer covering 2 together with the exposed braided wires 3. The rib-like connecting portion 5 protrudes from the outer surface of the insulating outer covering 2 and so the area of contact thereof with the shield terminal 4 is sufficiently ensured. The amount of protrusion of the rib-like connecting portion 5 is adjusted by the distance (the length of the exposed braided wires 3) between the separated outer covering 2*a* and the insulating outer covering 2.

Figure 4:
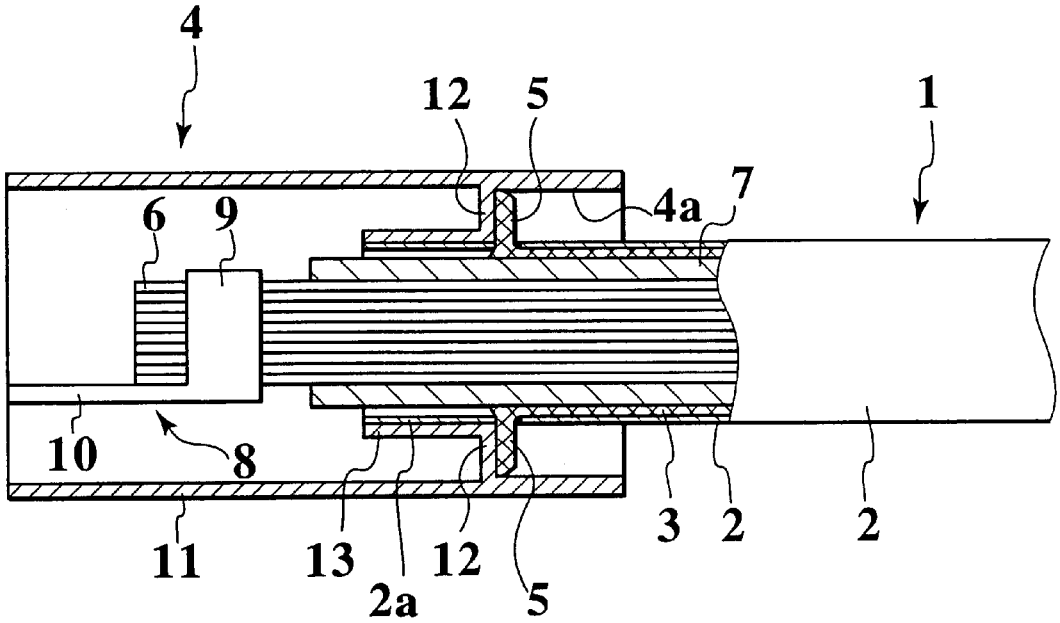
FIG. 4 is an enlarged sectional view illustrating the connection structure of the shield electric wire according to the embodiment.

At one end portion of the shield electric wire 1, as illustrated in FIGS. 1 and 2, there are exposed the core wires 6 by part of the insulating inner covering 7 being peeled away. As illustrated in FIG. 4, on the core wires 6 there is mounted a terminal metal fitting (terminal) 8. The terminal metal fitting 8, as illustrated in FIG. 1, is composed of a caulking connecting portion 9 that caulks the portions in the vicinity of forward ends of the core wires 6 and that is thereby electrically connected to these core wires 6, and a contacting portion 10 connected to a mating terminal not illustrated.

Figure 3A:
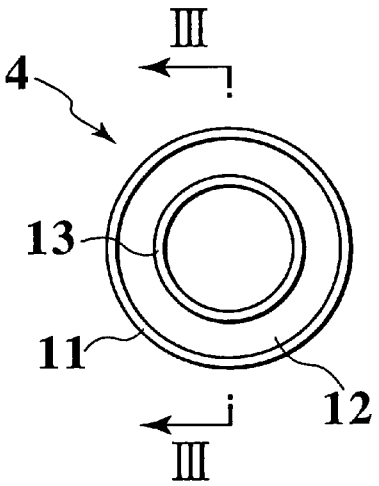
FIG. 3A is a front view illustrating a shield terminal in the connection structure of the shield electric wire according to the embodiment.
Figure 3B:
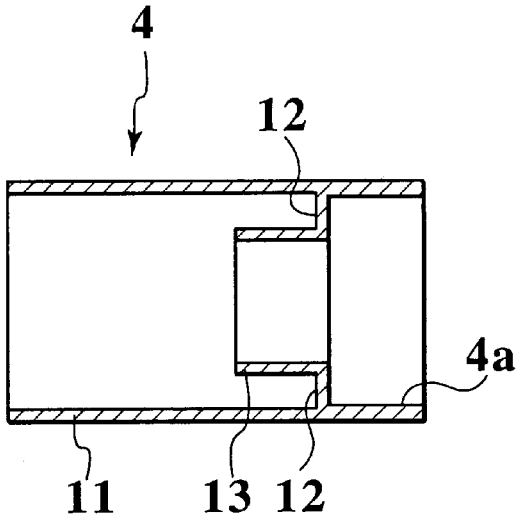
FIG. 3B is a sectional view taken along a line III—III of FIG. 3A.

As illustrated in FIG. 3, the shield terminal 4 has an outer hollow-cylinder 11, an inner hollow-cylinder 13 situated within the outer hollow-cylinder 11, and a connection portion 12 between the outer hollow-cylinder 11 and the inner hollow-cylinder 13. The shield terminal 4 is thereby integrally formed as a whole. The inner hollow-cylinder 13 is disposed in the vicinity of an opening 4*a* from which the shield electric wire 1 is inserted and has at least a size permitting the insertion therethrough of the shield electric wire 1.

The connection portion 12 has a configuration that is like a circular annulus. The outer hollow-cylinder 11 has a diameter larger than the inner hollow-cylinder 13 in order to accommodate therein a terminal processed portion of the shield electric wire 1 equipped with the terminal metal fitting 8.

As illustrated in FIG. 4, the shield electric wire 1 having the terminal metal fitting 8 mounted at the forward ends of the core wires 6 is inserted into the shield terminal 4. The rib-like connecting portion 5 gets contacted with the connection portion 12 in the fashion of a surface contact and this connecting portion 5 is electrically connected thereto by the use of various joining means. As the joining means there are adopted various kinds of joining means such as resistance welding, ultrasonic welding, adhesion, etc. The forward end of the terminal metal fitting 8 is accommodated within the shield terminal 4 without being caused to externally protrude from the shield terminal 4.

Next, the shield-terminal connection method with respect to the shield electric wire according to this embodiment will be explained.

Figure 5A:
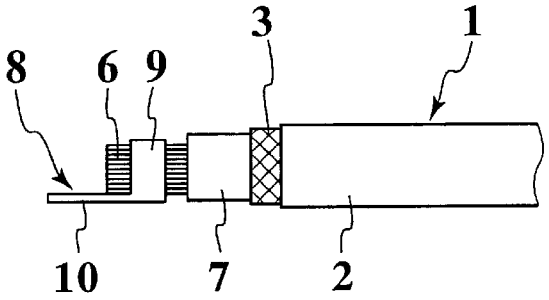
FIG. 5A is an enlarged view illustrating a main part of a step of mounting a terminal metal fitting in a shield-terminal connection method performed with respect to the shield electric wire according to the embodiment.

First, as illustrated in FIG. 5A, the method is to peel the coverings of the terminal portion of the shield electric wire 1 to thereby expose the core wires 6, insulating inner covering 7, and braided wires 3. Then it is also to caulk the portion in the vicinity of the forward ends of the core wires 6 by the terminal metal fitting 8 and connect this terminal metal fitting 8 to that portion.

Figure 5B:
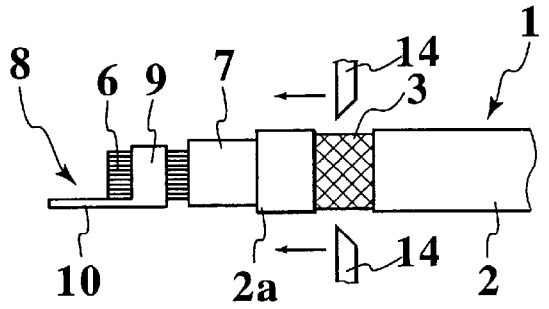
FIG. 5B is an enlarged view illustrating a main part of a step of performing outer-covering peeling of an insulating outer covering in the shield-terminal connection method performed with respect to the shield electric wire according to the embodiment.

Next, as illustrated in FIG. 5B, the method is to cut part of the insulating outer covering 2 by means of a cutter, etc. and separate it from the remaining portion thereof. Then it is to drag this cut part toward the terminal metal fitting 8 to thereby expose the braided wires 3 externally. The separated outer covering 2*a* is not completely drawn away from the braided wires 3 and so the ends of the braided wires 3 remain within the separated outer covering 2*a*.

Figure 5C:
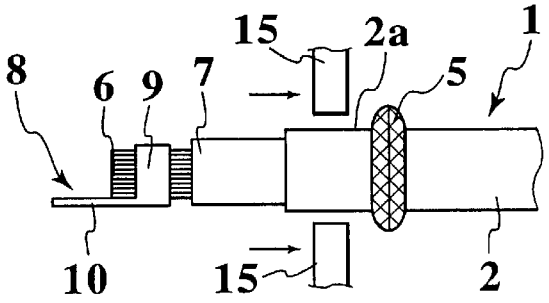
FIG. 5C is an enlarged view illustrating a main part of a step of forming a rib-like connecting portion in the shield-terminal connection method performed with respect to the shield electric wire according to the embodiment.
Figure 5D:
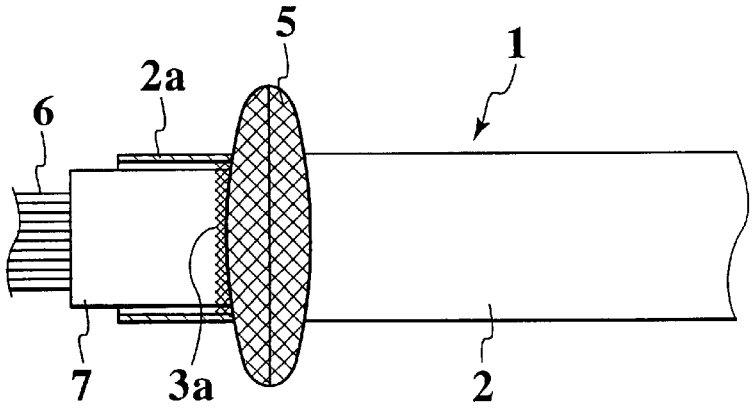
FIG. 5D is an enlarged view illustrating a main part of a state of a separated outer covering being pressed against the rib-like connecting portion in the shield-terminal connection method performed with respect to the shield electric wire according to the embodiment.
Figure 6:
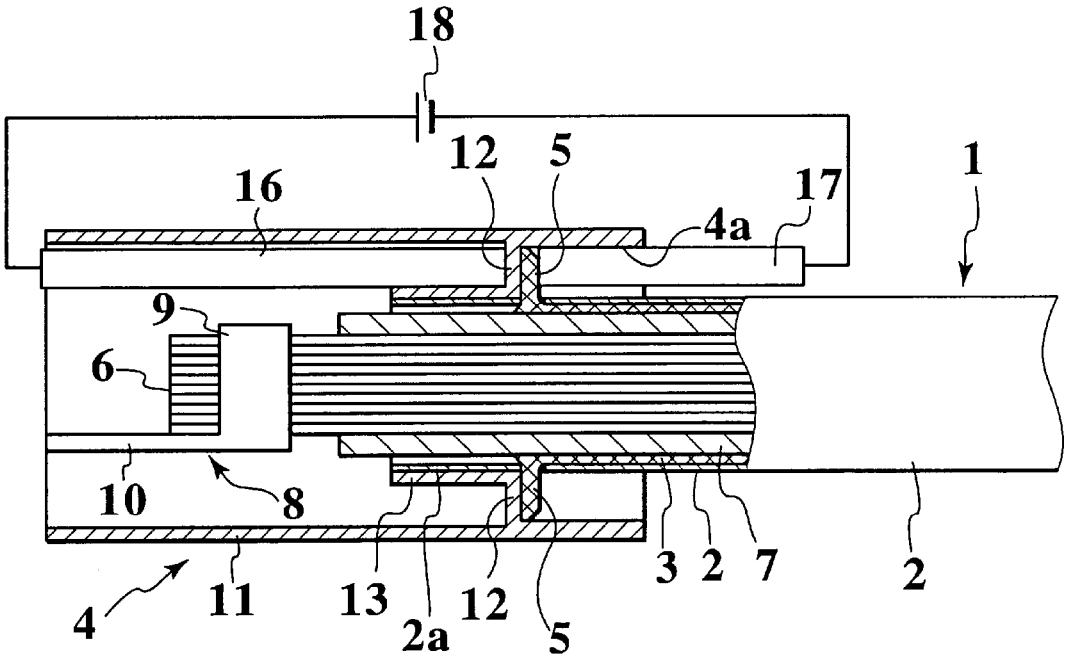
FIG. 6 is an enlarged sectional view illustrating a connecting portion of the shield terminal and the rib-like connecting portion that have been connected by resistance welding.

Next, as illustrated in FIG. 5C, the method is to draw up the separated outer covering 2*a* toward the end of the insulating outer covering 2 by a damper 15, etc. As a result of this, the exposed braided wires 3 is externally loosened by degrees in correspondence with the movement of the separated outer covering 2*a*. Eventually, the braided wires 3 are clamped between the separated outer covering 2*a* and the insulating outer covering 2 to thereby form the rib-like connecting portion 5 having the shape of a circular disk. At this time, as shown in FIG. 5D, the terminal end portions 3*a* of the braided wires 3 are drawn into the interior of the separated outer covering 2*a*.

Next, as illustrated in FIG. 4, the shield terminal 4 is inserted over the terminal processed portion of the shield electric wire 1, and this terminal 4 is forced in until the connection portion 12 contacts with the rib-like connecting portion 5.

Next, one electrode 16 is inserted into a space formed between the outer hollow-cylinder 11 of the shield terminal 4 and the inner hollow-cylinder 13 while another electrode 17 is inserted into a space formed between the outer hollow-cylinder 11 and the shield electric wire 1.

Finally, forward ends of the electrodes 16 and 17 are pressed against the connection portion 12 and the rib-like connecting portion 5, respectively. In this condition, a prescribed voltage is applied from a power source portion 18 to between the electrodes 16 and 17. As a result, the rib-like connecting portion 5 and the connection portion 12 are resistance-welded due to the heat generated by application of the voltage and are metal-joined together. As a result of this, the electrical-connection performance between the rib-like connecting portion 5 and the connection portion 12 is remarkably graded up.

In the above-constructed connection structure of the shield electric wire according to this embodiment, the shield terminal 4 is connected to the rib-like connecting portion 5 prepared by drawing up the exposed braided wires 3 to the end surface of the insulating outer covering 2 and collecting them together. Since the rib-like connecting portion 5 and the shield terminal 4 are joined to each other in the fashion of a surface contact, the reliability on the connection between these two elements 5 and 4 is greatly enhanced. Simultaneously, fraying of the terminal ends of the braided wires 3 is suppressed.

Also, because the rib-like connecting portion 5 and the core wires 6 are formed at their mutually separate positions, there is no need to cut the braided wires 3 for the purpose of preventing the occurrence of a short-circuiting.

Also, the outer covering 2*a* that has been partly separated from the insulating outer covering 2 is used to prevent the fraying of the terminal end portions 3*a* of the braided wires 3 without being taken away.

Further, because the shield terminal 4 is connected to the forward end of the shield electric wire 1 beforehand, the operation of mounting to the housing not illustrated becomes easy to perform.

In the shield-terminal connection method of the shield electric wire according to this embodiment, the braided wires 3 exposed from the insulating outer covering 2 are drawn up to the end surface of the insulating outer covering 2 and collected together. By doing so, the rib-like connecting portion 5 consisting of the braided wires 3 is formed. And to this rib-like connecting portion 5 is connected the shield terminal 4. For this reason, the rib-like connecting portion 5 and the shield terminal 4 are joined together in the fashion of a surface contact. As a result of this, the reliability on the connection between these two elements 5 and 4 is greatly enhanced. Also, because there is no need to cut and remove the braided wires 3 for the sake of preventing short-circuiting, the working operation efficiency is excellent.

Also, as mentioned above, the separated outer covering 2*a* is drawn up to the end surface of the insulating outer covering 2 together with the exposed braided wires 3, and the rib-like connecting portion 5 consisting of the braided wires 3 is thereby formed. And to this rib-like connecting portion 5 is connected the shield terminal 4. Therefore, the reliability on the connection between the rib-like connecting portion 5 and the shield terminal 4 is enhanced. In addition, the fraying of the terminal end portions of the braided wires 3 is prevented by the separated outer covering 2*a* that is to be thrown away.

Although an explanation has been above given of the concrete embodiment to which the present invention has been applied, this invention is not limited thereto and permits various changes and modifications to be made.

Figure 7:
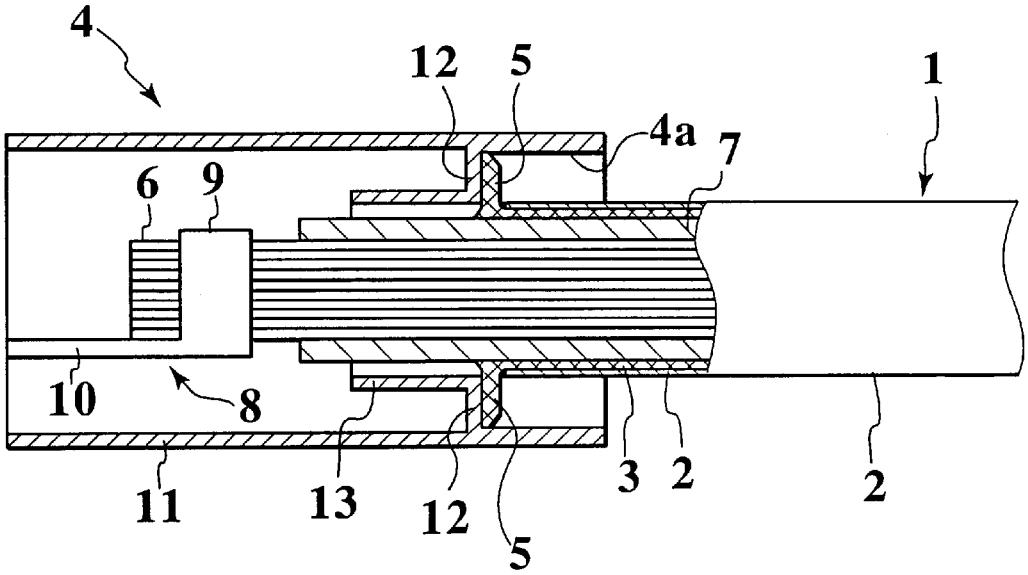
FIG. 7 is an enlarged sectional view illustrating the connection structure of the shield electric wire, the rib-like connecting portion of that has been formed using only braided wires alone with the peeled-off insulating outer covering thereof being taken away therefrom.

In the above-described embodiment, the rib-like connecting portion 5 has been formed using the outer covering 2*a* that has been partly separated from the insulating outer covering 2. However, as illustrated in FIG. 7, the rib-like connecting portion 5 may be formed by eliminating the separated outer covering 2*a* and drawing up the braided wires 3 to the side of the cut end surface manually or by means of a jig. In this case, even when there exists no separated outer covering 2*a*, the connection portion 12 is connected to the rib-like connecting portion 5 in the fashion of a surface contact. Therefore, the fraying of the ends of the braided wires 3 is prevented.

What is claimed is:

1. A connection structure between a shield terminal and a shield electric wire, comprising:

a shield electric wire having braided wires, an outer insulating portion for covering the braided wires, and a connecting portion formed by part of the braided wires, the connecting portion having a rib-like configuration formed by drawing up the braided wires to an end of the outer insulating portion and collecting them together so as to extend and expose from the end of the outer insulating portion; and a shield terminal connected to the connecting portion.

2. A connection structure according to claim 1, wherein the shield electric wire has an inner insulating portion, the braided wires cover the inner insulating portion, and the part of the braided wires that forms the rib-like connecting portion includes those wires that extend from the end of the outer insulating portion and are exposed on the outer peripheral surface of a protruding portion of the inner insulating portion.

3. A connection structure according to claim 2, wherein the connecting portion has a substantially circular disk-like configuration that protrudes in a radial direction of the outer insulating portion.

4. A connection structure according to claim 2, further comprising:

a second outer insulating portion that is separated from the end of the outer insulating portion and that remains on the protruding portion of the inner insulating portion, the second insulating portion covering ends of the braided wires that form the connecting portion.

5. A connection structure according to claim 4, wherein the second outer insulating portion is situated near the end of the outer insulating portion.

6. A connection structure according to claim 1, wherein the shield terminal has an outer hollow-cylinder, an inner hollow-cylinder, and a connection portion between the outer hollow-cylinder and the inner hollow-cylinder, and the connecting portion is connected to the connection portion.

7. A connection method of a shield electric wire, the shield electric wire having braided wires and an outer insulating portion for covering the braided wires, the connection method comprising the steps of:

causing end portions of the braided wires to be exposed from an end of the outer insulating portion;

drawing up the exposed end portions to the end of the outer insulating portion to thereby form a rib-like connecting portion; and connecting the connecting portion to a shield terminal.

8. A connection method according to claim 7, wherein the shield electric wire has an inner insulating portion, the braided wires cover the inner insulating portion, and the end portions of the braided wires that forms the rib-like connecting portion extend from the end of the outer insulating portion and are exposed on the outer peripheral surface of a protruding portion of the inner insulating portion.

9. A connection method according to claim 8, wherein the connecting portion has a substantially circular disk-like configuration that protrudes in a radial direction of the outer insulating portion.

10. A connection method of a shield electric wire, the shield electric wire having an inner insulating portion, braided wires situated on the inner insulating portion, and an outer insulating portion for covering the braided wires, the connection method comprising the steps of:

providing a second outer insulating portion that is separated from an end of the outer insulating portion and dragged away from the end of the outer insulating portion to expose the braided wires, the second outer insulating portion remaining to exist on the inner insulating portion in a state of its covering ends of the braided wires;

drawing up the second outer insulating portion to the end of the outer insulating portion and collecting the braided wires exposed between the outer insulating portion and the second outer insulating portion together to the end of the outer insulating portion to thereby form a rib-like connecting portion; and connecting the connecting portion to a shield terminal.

11. A connection method according to claim 10, wherein the connecting portion has a substantially circular disk-like configuration that protrudes in a radial direction of the outer insulating portion.

12. A connection method according to claim 10, wherein the second outer insulating portion is situated near the end of the outer insulating portion.

13. A connection method according to claim 10, wherein the shield terminal has an outer hollow-cylinder, an inner hollow-cylinder, and a connection portion between the outer hollow-cylinder and the inner hollow-cylinder, and the connecting portion is connected to the connection portion.

* * * * *

UNITED STATES PATENT AND TRADEMARK OFFICE

CERTIFICATE OF CORRECTION

PATENT NO. : 6,332,807 B1
DATED : December 25, 2001
INVENTOR(S) : Nobuyuki Asakura and Yasumichi Kuwayama It is certified that error appears in the above-identified patent and that said Letters Patent is hereby corrected as shown below:

Column 6,
Line 50, "that forms" should read -- that form --.

Signed and Sealed this

Seventh Day of May, 2002

*Attest:*

*Attesting Officer*

JAMES E. ROGAN
*Director of the United States Patent and Trademark Office*